US011509084B2

(12) United States Patent
Consoli et al.

(10) Patent No.: US 11,509,084 B2
(45) Date of Patent: Nov. 22, 2022

(54) ELECTRICAL CONNECTOR ASSEMBLY HAVING HYBRID CONDUCTIVE POLYMER CONTACTS

(71) Applicant: TE Connectivity Services GmbH, Schaffhausen (CH)

(72) Inventors: John Joseph Consoli, Harrisburg, PA (US); Chad William Morgan, Carneys Point, NJ (US); Megan Hoarfrost Beers, Redwood City, CA (US); Lei Wang, San Jose, CA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 16/937,910

(22) Filed: Jul. 24, 2020

(65) Prior Publication Data

US 2022/0029330 A1 Jan. 27, 2022

(51) Int. Cl.

| | |
|---|---|
| ***H01R 12/00*** | (2006.01) |
| ***H01R 13/03*** | (2006.01) |
| ***H01R 12/71*** | (2011.01) |
| ***H01R 13/24*** | (2006.01) |
| ***H01R 13/405*** | (2006.01) |
| ***H01R 12/52*** | (2011.01) |

(52) U.S. Cl.

CPC ..... *H01R 13/03* (2013.01); *H01R 12/52* (2013.01); *H01R 12/714* (2013.01); *H01R 12/716* (2013.01); *H01R 13/24* (2013.01); *H01R 13/405* (2013.01)

(58) Field of Classification Search

CPC .... H01R 12/52; H01R 12/714; H01R 12/716; H01R 13/03; H01R 13/035; H01R 13/24; H01R 13/405

USPC ..... 439/65–75

See application file for complete search history.

(56) References Cited

U.S. PATENT DOCUMENTS

| | | | |
|---|---|---|---|
| 5,527,591 | A | 6/1996 | Crotzer et al. |
| 5,599,193 | A | 2/1997 | Crotzer |
| 5,600,099 | A | 2/1997 | Crotzer et al. |

(Continued)

FOREIGN PATENT DOCUMENTS

| | | | |
|---|---|---|---|
| KR | 101393601 | B1 | 5/2014 |
| KR | 101959536 | B1 | 10/2017 |
| KR | 102113732 | B1 | 5/2020 |

*Primary Examiner* — Khiem M Nguyen

(57) ABSTRACT

An electrical connector assembly is provided and includes a carrier having an upper surface and a lower surface. The lower surface is configured to face a host circuit board. The upper surface is configured to face a component circuit board of an electrical component. The carrier includes a plurality of contact openings therethrough. The electrical connector assembly includes contacts coupled to the carrier and passing through the corresponding contact openings. Each contact has a conductive polymer column extending between an upper mating interface and a lower mating interface. The conductive polymer column is compressible between the upper mating interface and the lower mating interface. The conductive polymer column includes an inner core and an outer support body. The inner core is manufactured from a first material. The outer support body is manufactured from a second material. The second material has a lower compression set than the first material. The first material has a higher electrical conductivity than the second material.

20 Claims, 7 Drawing Sheets

(56) References Cited

U.S. PATENT DOCUMENTS

| | | | | |
|---|---|---|---|---|
| 5,766,021 | A | 6/1998 | Pickles et al. | |
| 5,871,842 | A | 2/1999 | Crotzer et al. | |
| 5,949,029 | A | 9/1999 | Crotzer et al. | |
| 6,345,989 | B1 | 2/2002 | Mason et al. | |
| 6,790,057 | B2 | 9/2004 | DelPrete et al. | |
| 6,796,810 | B2 | 9/2004 | Delprete et al. | |
| 7,391,227 | B2 | 6/2008 | Inoue et al. | |
| 7,393,471 | B2 | 7/2008 | Inoue et al. | |
| 7,448,883 | B2 | 11/2008 | Alden, III et al. | |
| 7,549,870 | B2 | 6/2009 | Mason et al. | |
| 7,585,173 | B2 | 9/2009 | Hilty et al. | |
| 7,686,624 | B2 | 3/2010 | Mason et al. | |
| 7,722,360 | B2 | 5/2010 | Millard et al. | |
| 7,726,976 | B2 | 6/2010 | Mason et al. | |
| 7,726,984 | B2 | 6/2010 | Bumb, Jr. et al. | |
| 7,821,283 | B2 | 10/2010 | Yamada et al. | |
| 7,878,818 | B2 | 2/2011 | Cheng et al. | |
| 8,172,623 | B1 * | 5/2012 | Zhu | H01R 13/2428 439/709 |
| 8,202,100 | B2 * | 6/2012 | Luo | H01R 13/2435 439/66 |
| 8,282,431 | B1 * | 10/2012 | Zhang | H01R 13/2435 439/862 |
| 8,366,453 | B2 * | 2/2013 | Chang | H01R 12/58 439/70 |
| 8,926,343 | B2 | 1/2015 | Mason et al. | |
| 2008/0188127 | A1 | 8/2008 | Alden et al. | |
| 2008/0242128 | A1 | 10/2008 | Hilty et al. | |
| 2009/0088005 | A1 | 4/2009 | Mason et al. | |
| 2010/0291774 | A1 | 11/2010 | Cheng et al. | |
| 2014/0141632 | A1 | 5/2014 | Mason et al. | |
| 2020/0150148 | A1 | 5/2020 | Chung | |

* cited by examiner

ELECTRICAL CONNECTOR ASSEMBLY HAVING HYBRID CONDUCTIVE POLYMER CONTACTS

BACKGROUND OF THE INVENTION

The subject matter herein relates generally to electrical connector assemblies.

The ongoing trend toward smaller, lighter, and higher performance electrical components and higher density electrical circuits has led to the development of surface mount technology in the design of printed circuit boards and electronic packages. Surface mountable packaging allows for a separable connection of an electronic package, such as an integrated circuit or a computer processor, to pads on the surface of the circuit board rather than by contacts or pins soldered in plated holes going through the circuit board. Surface mount technology may allow for an increased component density on a circuit board, thereby saving space on the circuit board.

One form of surface mount technology includes socket connectors. A socket connector may include a substrate holding an array of contacts. Some known socket connectors have an array of conductive polymer columns that are compressible to provide an interposer between the host circuit board and the electronic package. However, known socket connectors have a low deflection and working range. Conductive polymers may exhibit stress relaxation over time as the loading material disrupts and adversely affects the crosslinking of the polymer material. The material of the conductive polymer may experience permanent set or creep over time causing the socket connector to have a potentially limited working lifespan and the inability to be reused.

A need remains for an electrical connector assembly having improved contacts with an extended working lifespan.

BRIEF DESCRIPTION OF THE INVENTION

In an embodiment, an electrical connector assembly is provided. The electrical connector assembly includes a carrier having an upper surface and a lower surface. The lower surface is configured to face a host circuit board. The upper surface is configured to face a component circuit board of an electrical component. The carrier includes a plurality of contact openings therethrough. The electrical connector assembly includes contacts coupled to the carrier and passing through the corresponding contact openings. Each contact has a conductive polymer column extending between an upper mating interface and a lower mating interface. The conductive polymer column is compressible between the upper mating interface and the lower mating interface. The conductive polymer column includes an inner core and an outer support body. The inner core is manufactured from a first material. The outer support body is manufactured from a second material. The second material has a lower compression set than the first material. The first material has a higher electrical conductivity than the second material.

In another embodiment, an electrical connector assembly includes a carrier having an upper surface and a lower surface. The lower surface is configured to face a host circuit board. The upper surface is configured to face a component circuit board of an electrical component. The carrier includes a plurality of contact openings therethrough. The electrical connector assembly includes contacts coupled to the carrier and passing through the corresponding contact openings. Each contact has a conductive polymer column extending between an upper mating interface and a lower mating interface. The conductive polymer column is compressible between the upper mating interface and the lower mating interface. The conductive polymer column includes an inner core and an outer support body. The inner core is manufactured from a conductive polymer material. The outer support body is manufactured from a non-conductive polymer material. The inner cores are spaced apart by gaps. The outer support bodies substantially fill the gaps.

In another embodiment. an electrical connector assembly is provided. The electrical connector assembly includes a carrier having an upper surface and a lower surface. The lower surface is configured to face a host circuit board. The upper surface is configured to face a component circuit board of an electrical component. The carrier includes a plurality of contact openings therethrough. The electrical connector assembly includes contacts coupled to the carrier and passing through the corresponding contact openings. Each contact has a conductive polymer column extending between an upper mating interface and a lower mating interface. The conductive polymer column is compressible between the upper mating interface and the lower mating interface. The conductive polymer column includes an inner core and an outer support body defined by the carrier. The outer support body extends between the upper surface and the lower surface. The inner core is manufactured from a first material. The carrier defines the outer support body being manufactured from a second material. The second material has a lower compression set than the first material. The first material has a higher electrical conductivity than the second material.

DETAILED DESCRIPTION OF THE INVENTION

Figure 1:
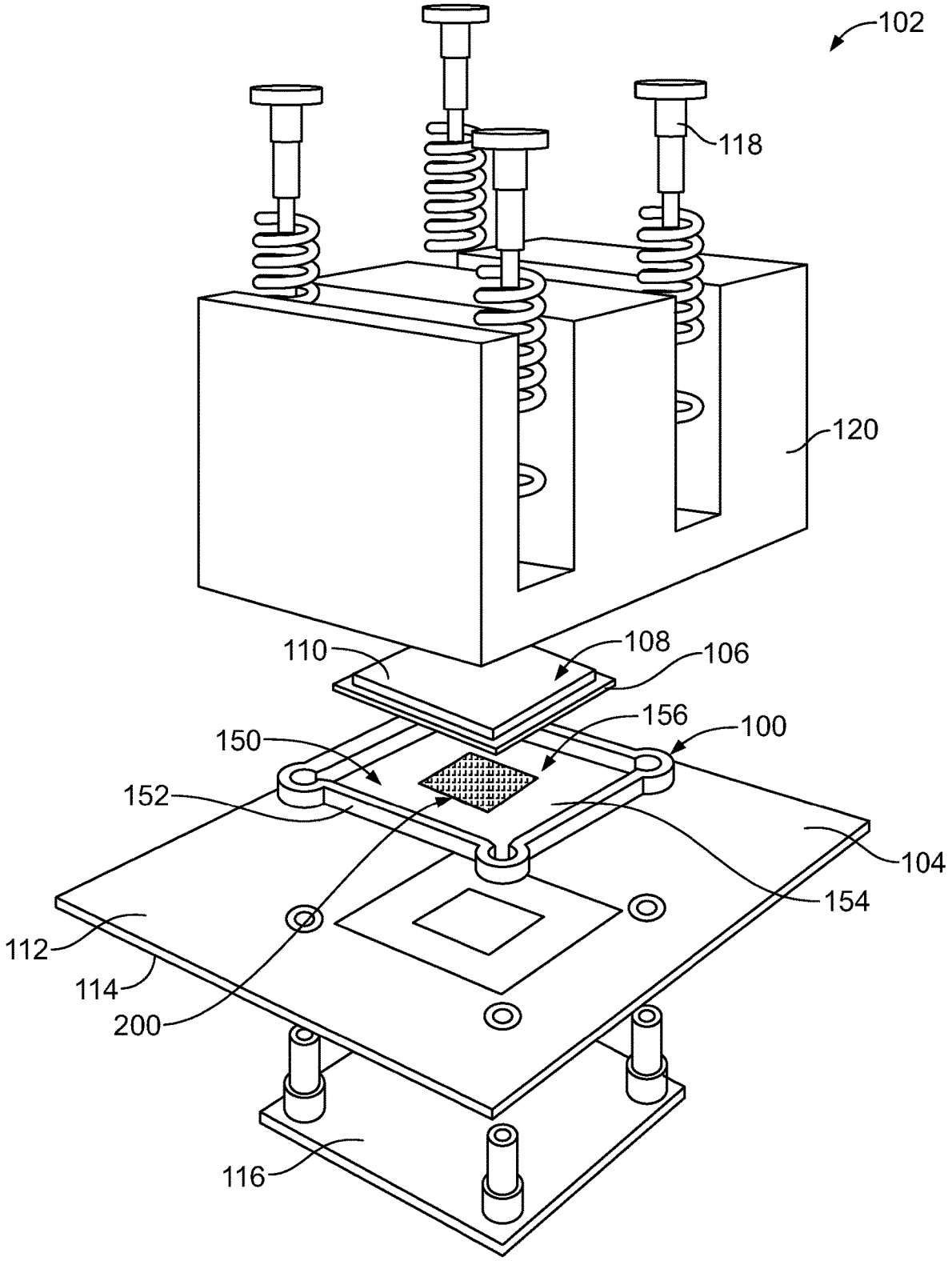
FIG. 1 is an exploded view of an electrical connector assembly in accordance with an exemplary embodiment for an electrical system.
Figure 2:
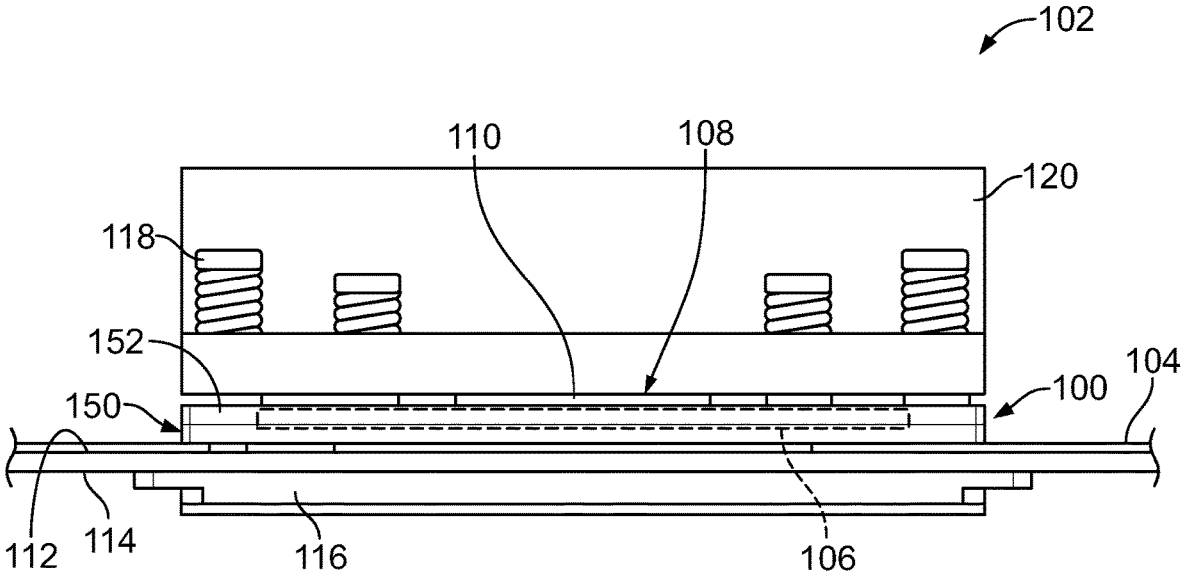
FIG. 2 is a side view of the electrical connector assembly of the electrical system in accordance with an exemplary embodiment.

FIG. 1 is an exploded view of an electrical connector assembly 100 in accordance with an exemplary embodiment for an electrical system 102. FIG. 2 is a side view of the electrical connector assembly 100 of the electrical system 102 in accordance with an exemplary embodiment. The electrical system 102 includes a host circuit board 104 and a component circuit board 106 (shown in phantom) of an electrical component 108. The electrical connector assembly 100 is used to electrically connect the component circuit board 106 with the host circuit board 104. In various embodiments, the electrical component 108 is an electronic package, such as an ASIC. For example, the electrical component 108 may include a chip 110 mounted to the component circuit board 106.

The host circuit board 104 includes an upper surface 112 and a lower surface 114. The electrical connector assembly 100 is mounted to the upper surface 112 of the host circuit board 104. In an exemplary embodiment, a backer plate 116 is provided at the lower surface 114 to stiffen the host circuit board 104. The electrical connector assembly 100 may be coupled to the backer plate 116 through the host circuit board 104, such as using fasteners 118.

In an exemplary embodiment, a thermal plate 120 (FIG. 1) is thermally coupled to the electrical component 108 to dissipate heat from the electrical component 108. For example, the plate 120 may be used to dissipate heat from the chip 110. The thermal plate 120 may be a heatsink or a cold plate in various embodiments. Other types of thermal plates may be used in alternative embodiments. The plate 120 may be coupled to the electrical connector assembly 100 and/or the host circuit board 104 and/or the backer plate 116 in various embodiments.

In an exemplary embodiment, the electrical connector assembly 100 includes a compressible interface for receiving the electrical component 108. The electrical connector assembly 100 is electrically connected to the chip 110 through the component circuit board 106. In an exemplary embodiment, the thermal plate 120 is coupled to the top of the chip 110 to dissipate heat from the chip 110. The backer plate 116 may be used to secure the thermal plate 120 and/or the electrical component 108 and/or the electrical connector assembly 100 to the host circuit board 104.

In an exemplary embodiment, the electrical connector assembly 100 includes an interposer 150 that holds a plurality of contacts 200. In an exemplary embodiment, the contacts 200 are conductive polymer contacts. The contacts 200 may be metallized particle interconnects. The contacts 200 are configured to be electrically connected to the host circuit board 104 and are configured to be electrically connected to the component circuit board 106 to transmit data signals therebetween. The contacts are held in a contact array. In an exemplary embodiment, the array of contacts is configured to be coupled to the component circuit board 106 at a separable interface and configured to be coupled to the host circuit board 104 at a separable interface. For example, the contacts 200 may form a land grid array (LGA) interface with the component circuit board 106 and may form an LGA interface with the host circuit board 104.

In various embodiments, the electrical connector assembly 100 includes a support frame 152 holding the interposer 150 and configured to hold the electrical component 108. The support frame 152 may be a socket frame forming a socket that receives the electrical component 108. The interposer 150 includes a carrier 154 holding the contacts 200. The carrier 154 is coupled to the support frame 152. For example, the support frame 152 may include a socket opening 156 that receives the electrical component 108. The carrier 154 is held in the socket opening 156 for interfacing with the electrical component 108, such as the component circuit board 106. The support frame 152 is used to position the component circuit board 106 relative to the interposer 150 and the contacts 200. The support frame 152 may be secured to the host circuit board 104 and/or the backer plate 116 using fasteners 118. The thermal plate 120 may be coupled to the support frame 152. Optionally, the support frame 152 may position the thermal plate 120 relative to the electrical component 108, such as to limit compression of the thermal plate 120 against the electrical component 108. In alternative embodiments, the interposer 150 may be provided without the support frame 152.

Figure 3:
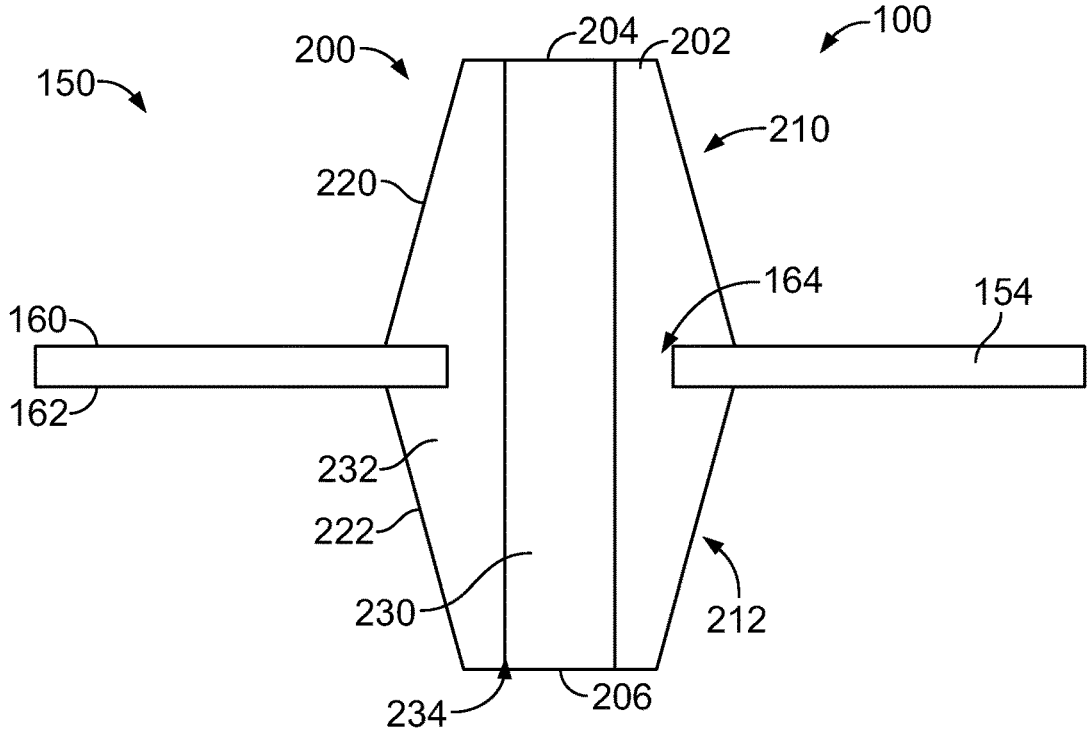
FIG. 3 is a cross-sectional view of a portion of the electrical connector assembly in accordance with an exemplary embodiment showing one of the contacts coupled to the carrier.

FIG. 3 is a cross-sectional view of a portion of the electrical connector assembly 100 in accordance with an exemplary embodiment showing one of the contacts 200 coupled to the carrier 154. The interposer 150 includes the carrier 154 holding the contacts 200. The carrier 154 may be a plate or film that supports the contacts 200. The carrier 154 is manufactured from a dielectric material to electrically isolate the contacts 200. For example, the carrier 154 may be a polyimide film. The carrier 154 includes an upper surface 160 and a lower surface 162. The carrier 154 includes a plurality of contact openings 164 extending between the upper surface 160 and the lower surface 162. The contact openings 164 receive the contacts 200. In various embodiments, the contacts 200 are molded in situ into the carrier 154. For example, the material of the contacts 200 passes through the contact openings 164 during the molding process to form the contact 200 above the upper surface 160 and below the lower surface 162. The contacts 200 may be molded in a single molding step or multiple molding steps. In various embodiments, the contacts 200 may be formed by transfer molding, compression molding, injection molding, dispensing, printing, and the like.

In an exemplary embodiment, each contact 200 includes a conductive polymer column 202 extending between an upper mating interface 204 at the top of the contact 200 and a lower mating interface 206 at the bottom of the contact 200. The conductive polymer column 202 is compressible between the upper mating interface 204 and the lower mating interface 206. The upper and lower mating interfaces 204, 206 form separable mating interfaces. The upper and lower mating interfaces 204, 206 may form upper and lower LGAs. The conductive polymer column 202 may include a metallized particle interconnect in various embodiments along at least a portion of the conductive polymer column 202.

In an exemplary embodiment, the conductive polymer column 202 of each contact 200 includes an upper portion 210 above the upper surface 160 of the carrier 154 and a lower portion 212 below the lower surface 162 of the carrier 154. The upper portion 210 extends between the upper surface 160 and the upper mating interface 204. The lower portion 212 extends between the lower surface 162 and the lower mating interface 206. In an exemplary embodiment, the conductive polymer columns 202 are frustoconical shaped. For example, the upper portion 210 is frustoconical shaped and the lower portion 212 is frustoconical shaped. For example, an upper portion wall 220 is tapered between the upper surface 160 and the upper mating interface 204 and a lower portion wall 222 is tapered between the lower surface 162 and the lower mating interface 206. The upper portion 210 has a first upper diameter at the upper surface 160 and a second upper diameter at the upper mating interface 204 less than the first upper diameter. The lower portion 212 has a first lower diameter at the lower surface 162 and a second lower diameter at the lower mating interface 206 less than the first lower diameter.

In an exemplary embodiment, the conductive polymer column 202 includes an inner core 230 and an outer support body 232. The outer support body 232 includes a central bore 234. The inner core 230 is located in the central bore 234. In various embodiments, the central bore 234 may be cylindrical and the inner core 230 may be cylindrical. The outer support body 232 surrounds the inner core 230. In an exemplary embodiment, the inner core 230 and the outer support body 232 are manufactured from different materials. For example, the inner core 230 is manufactured from a first material, such as a conductive polymer material, and the outer support body 232 is manufactured from a second material, such as a non-conductive polymer material. The first material has a higher electrical conductivity than the second material. For example, the inner core 230 is manufactured from a polymer material having conductive particles, such as silver particles, embedded in the polymer base material. The inner core 230 is internally conductive through the first material of the inner core 230. The inner core 230 forms an electrically conductive path between the upper mating interface 204 and the lower mating interface 206.

In an exemplary embodiment, the second material of the outer support body 232 has a lower compression set than the first material. The compression set is the amount of permanent deformation remaining after removal of force. The lower compression set of the second material means less permanent deformation of the second material. In other words, the second material has a greater ability to return to shape when the force is removed. In various embodiments, the outer support body 232 is manufactured from a non-conductive polymer material, such as a silicone rubber material, such as a heat cured rubber. The inner core 230 is compressible with the outer support body 232 and the outer support body 232 provides compression support for the inner core 230. The outer support body 232 is used to return the inner core 230 to a released or non-compressed state. The outer support body 232 presses against the inner core 230 when released to return the inner core 230 to the normal, uncompressed position. The elastic nature of the second material of the outer support body 232 reduces permanent set or creep of the conductive polymer column 202 (for example, permanent set or creep of the material of the inner core 230). The outer support body 232 increases the elasticity of the conductive polymer column 202.

In an exemplary embodiment, the outer support body 232 is formed in place on the carrier 154. For example, the outer support body 232 is secured to the carrier 154 by a first molding using a first mold. The outer support body 232 includes the central bore 234. Optionally, the central bore 234 may be formed during the molding process. Alternatively, the central bore 234 may be formed after being molded, such as by drilling or otherwise removing a portion of the outer support body 232. In various embodiments, the inner core 230 is secured to the outer support body 232 by a second molding in the central bore 234 of the outer support body 232. The inner core 230 defines an electrical path between the upper and lower mating interfaces 204, 206. The outer support body 232 provides mechanical support for the inner core 230. The elastic nature of the outer support body 232 increases the overall spring characteristics of the contact 200 and prolongs the operating life of the contact 200 by reducing or eliminating permanent set or creep of the inner core 230.

In alternative embodiments, the inner core 230 may be secured to the carrier 154 prior to the outer support body 232. For example, the inner core 230 may be molded onto the carrier 154 in a first molding process and the outer support body 232 is molded over the inner core 230 by a second molding process.

Figure 4:
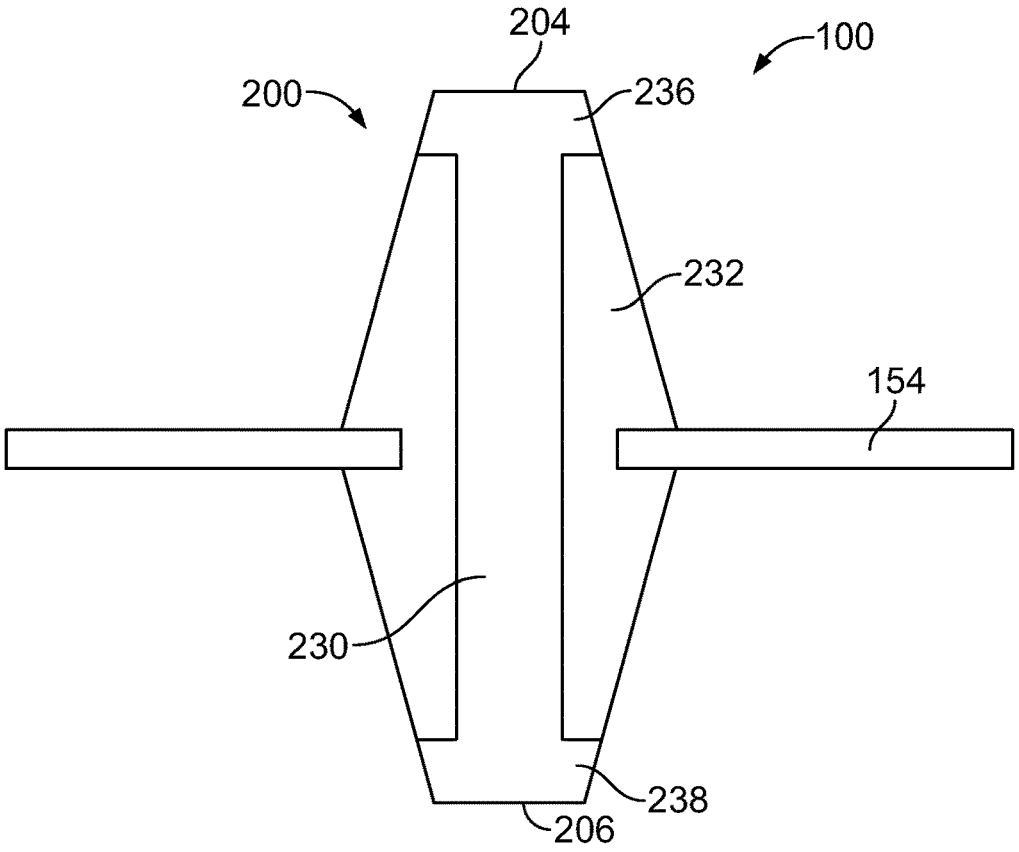
FIG. 4 is a cross-sectional view of a portion of the electrical connector assembly in accordance with an exemplary embodiment showing one of the contacts coupled to the carrier.

FIG. 4 is a cross-sectional view of a portion of the electrical connector assembly 100 in accordance with an exemplary embodiment showing one of the contacts 200 coupled to the carrier 154. In the illustrated embodiment, the inner core 230 of the contact 200 includes an upper cap 236 and a lower cap 238. The upper cap 236 is provided at the upper mating interface 204 and the lower cap 238 is provided at the lower mating interface 206.

The upper and lower caps 236, 238 are formed integral with the inner core 230. For example, the upper and lower caps 236, 238 are formed during the molding process that forms the inner core 230. In various embodiments, the upper cap 236 partially covers the top of the outer support body 232. In other various embodiments, the upper cap 236 fully covers the top of the outer support body 232. The top of the outer support body 232 supports the upper cap 236. The outer support body 232 presses outward against the upper cap 236 when the contact 200 is released to return the contact 200 to the released position. The upper cap 236 increases a surface area of the inner core 230 at the upper mating interface 204 for electrical connection with the component circuit board 106. In various embodiments, the lower cap 238 partially covers the bottom of the outer support body 232. In other various embodiments, the lower cap 238 fully covers the bottom of the outer support body 232. The bottom of the outer support body 232 supports the lower cap 238. The outer support body 232 presses outward against the lower cap 238 when the contact 200 is released to return the contact 200 to the released position. The lower cap 238 increases a surface area of the inner core 230 at the lower mating interface 206 for electrical connection with the host circuit board 104.

Figure 5:
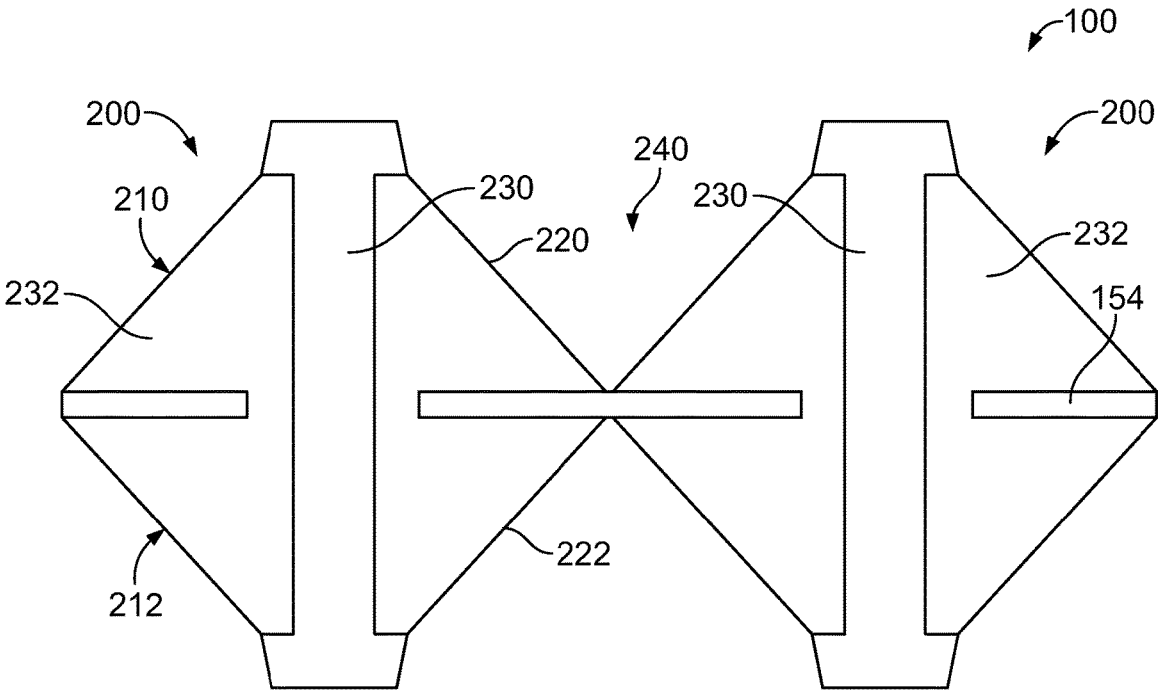
FIG. 5 is a cross-sectional view of a portion of the electrical connector assembly in accordance with an exemplary embodiment showing a pair of the contacts coupled to the carrier.

FIG. 5 is a cross-sectional view of a portion of the electrical connector assembly 100 in accordance with an exemplary embodiment showing a pair of the contacts 200 coupled to the carrier 154. In the illustrated embodiment, the outer support body 232 is widened at the carrier 154 compared to the embodiment illustrated in FIGS. 3 and 4. For example, the upper portion wall 220 and the lower portion wall 222 are tapered at approximately 45°.

In an exemplary embodiment, the outer support body 232 is shaped to fill the gap 240 between the contacts 200. For example, the outer support body 232 may abut against the adjacent outer support body 232. In the illustrated embodiment, the outer support bodies 232 touch each other at the bases of the upper portions 210 and the bases of the lower portions 212. The widened bases of the outer support body 232 provide additional mechanical support for the contacts 200. Because the outer support bodies 232 are non-conductive, the outer support bodies 232 are able to be positioned in close proximity to each other or even touch each other while still providing electrical isolation for the inner cores 230.

Figure 6:
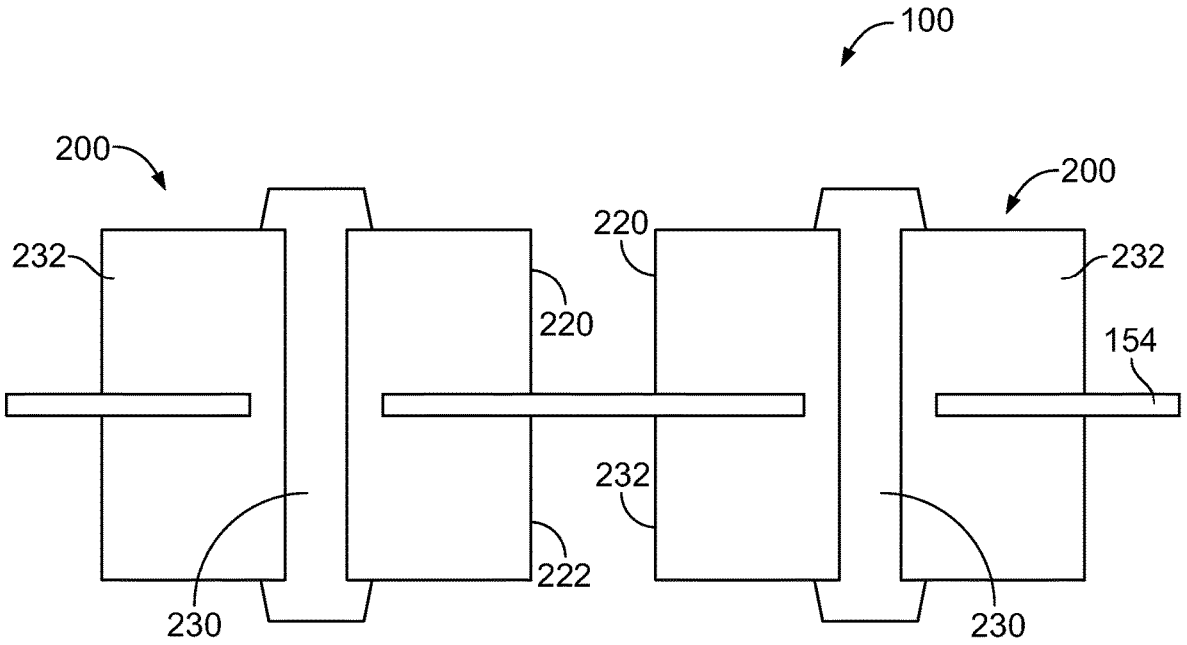
FIG. 6 is a cross-sectional view of a portion of the electrical connector assembly in accordance with an exemplary embodiment showing a pair of the contacts coupled to the carrier.

FIG. 6 is a cross-sectional view of a portion of the electrical connector assembly 100 in accordance with an exemplary embodiment showing a pair of the contacts 200 coupled to the carrier 154. In the illustrated embodiment, the outer support body 232 is widened compared to the embodiment illustrated in FIGS. 3 and 4. The outer support body 232 is widened along the entire height to provide better support for the inner cores 230. In the illustrated embodiment, the upper portion wall 220 and the lower portion wall 222 are rectangular rather than being tapered.

Figure 7:
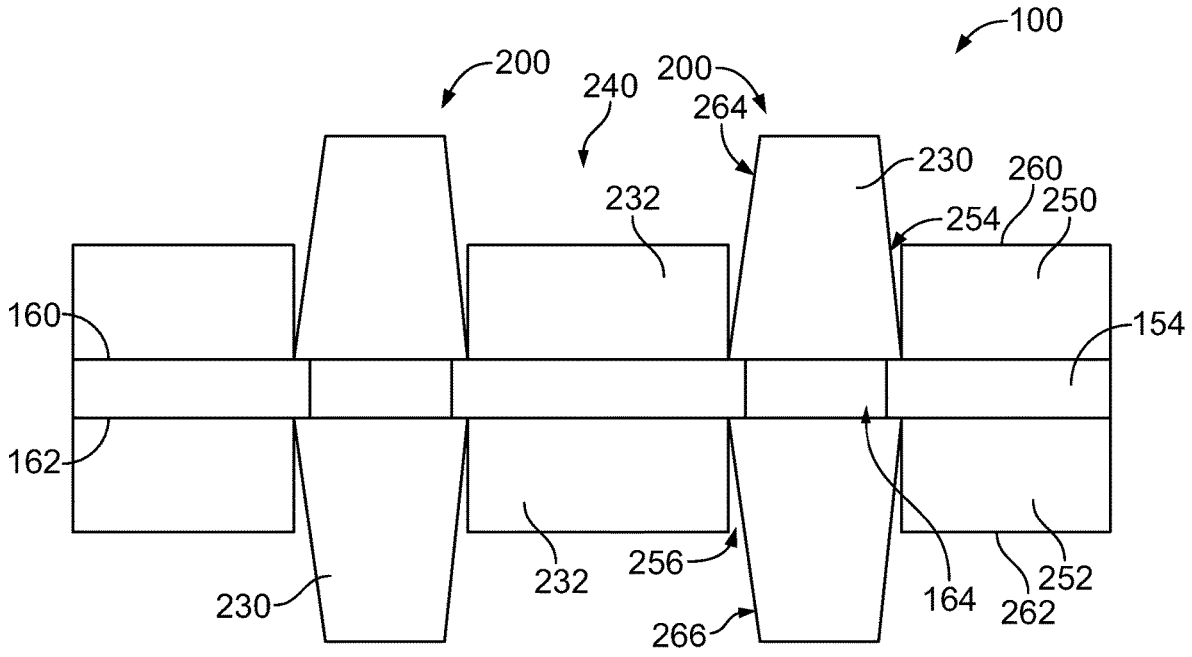
FIG. 7 is a side view of a portion of the electrical connector assembly in accordance with an exemplary embodiment showing a pair of the contacts coupled to the carrier.

FIG. 7 is a side view of a portion of the electrical connector assembly 100 in accordance with an exemplary embodiment showing a pair of the contacts 200 coupled to the carrier 154. In the illustrated embodiment, the outer support bodies 232 are integrated with each other as an upper sheet 250 and a lower sheet 252. The upper and lower sheets 250, 252 are coupled to the carrier 154, such as to the upper surface 160 and the lower surface 162, respectively, of the carrier 154. The upper and lower sheets 250, 252 may entirely cover or substantially cover the carrier 154 and define the outer support bodies 232 for all of the contacts 200. The upper sheet 250 engages the inner cores 230 of the contacts 200 and the lower sheet 252 engages the inner cores 230 of the contacts 200.

The upper sheet 250 includes upper openings 254. The lower sheet 252 includes lower openings 256. The upper and lower openings 254, 256 are aligned with the contact openings 164. The inner cores 230 pass through the contact openings 164 and the upper and lower openings 254, 256. In the illustrated embodiment, the inner core 230 includes an upper tip 264 extending above an outer surface 260 of the upper sheet 250 and the inner core 230 includes a lower tip 266 extending below an outer surface 262 of the lower sheet 252. The outer support bodies 232 substantially fill the gaps 240 between the inner cores 230. For example, the upper sheet 250 substantially fills the space between the upper portions of the inner cores 230 and the lower sheet 252 substantially fills the space between the lower portions of the inner cores 230. The outer support bodies 232 provide mechanical support for the inner cores 230. For example, as the inner cores 230 are compressed, the inner cores 230 are flexed outward into engagement with the upper sheet 250 and the lower sheet 252.

In an exemplary embodiment, the inner cores 230 are secured to the carrier 154 by molding the inner cores 230 in place on the carrier 154. The upper sheet 250 and the lower sheet 252, with the corresponding openings 254, 256 are placed onto the carrier 154 around the inner cores 230. The upper sheet 250 and the lower sheet 252 may be secured to the carrier 154, such as using adhesive.

Figure 8:
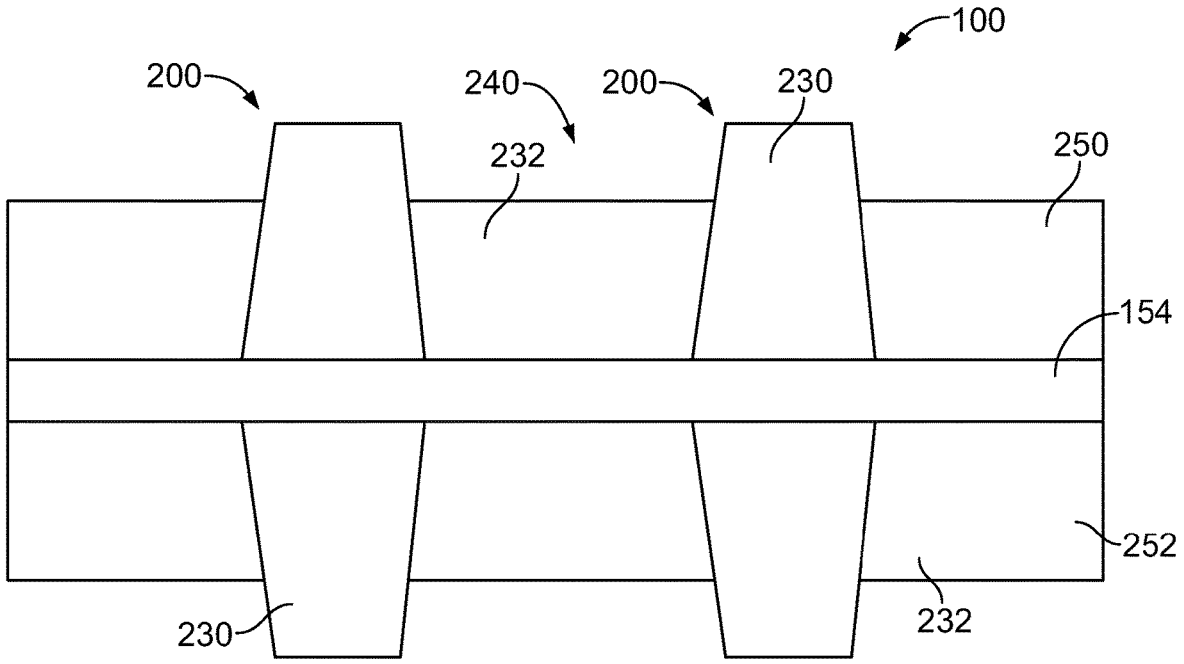
FIG. 8 is a side view of a portion of the electrical connector assembly in accordance with an exemplary embodiment showing a pair of the contacts coupled to the carrier.

FIG. 8 is a side view of a portion of the electrical connector assembly 100 in accordance with an exemplary embodiment showing a pair of the contacts 200 coupled to the carrier 154. In the illustrated embodiment, the outer support bodies 232 are integrated with each other as an upper sheet 250 and a lower sheet 252. In the illustrated embodiment, the upper and lower sheets 250, 252 are formed in place on the carrier 154 and the inner cores 230, rather than being separate, pre-formed sheets that are placed onto the carrier 154. For example, the upper and lower sheets 250, 252 are molded into the gaps 240 between the inner cores 230.

Figure 9:
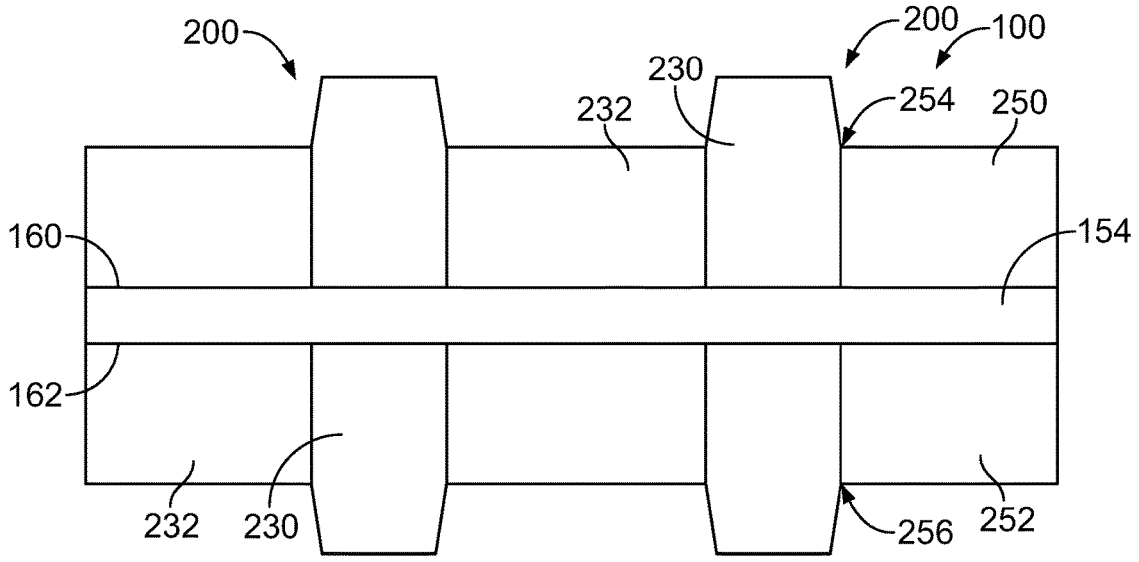
FIG. 9 is a side view of a portion of the electrical connector assembly in accordance with an exemplary embodiment showing a pair of the contacts coupled to the carrier.

FIG. 9 is a side view of a portion of the electrical connector assembly 100 in accordance with an exemplary embodiment showing a pair of the contacts 200 coupled to the carrier 154. In the illustrated embodiment, the outer support bodies 232 are integrated with each other as an upper sheet 250 and a lower sheet 252. In an exemplary embodiment, the inner cores 230 are added to the structure after the upper and lower sheets 250, 252 are formed on the carrier 154. For example, the upper and lower sheets 250, 252 may be molded onto the upper surface 160 and the lower surface 162 of the carrier 154. The openings 254, 256 may be formed either during the molding process or after molding, such as by drilling holes through the sheets 250, 252. The inner cores 230 may then be formed in place in the sheets 250, 252 and the carrier 154. In the illustrated embodiment, the inner cores 230 may be cylindrical through the upper and lower sheets 250, 252 rather than being tapered, which may make tooling simpler. The cylindrical shape of the inner cores 230 may form a more uniform column compared to tapered cores for improved force deflection.

Figure 10:
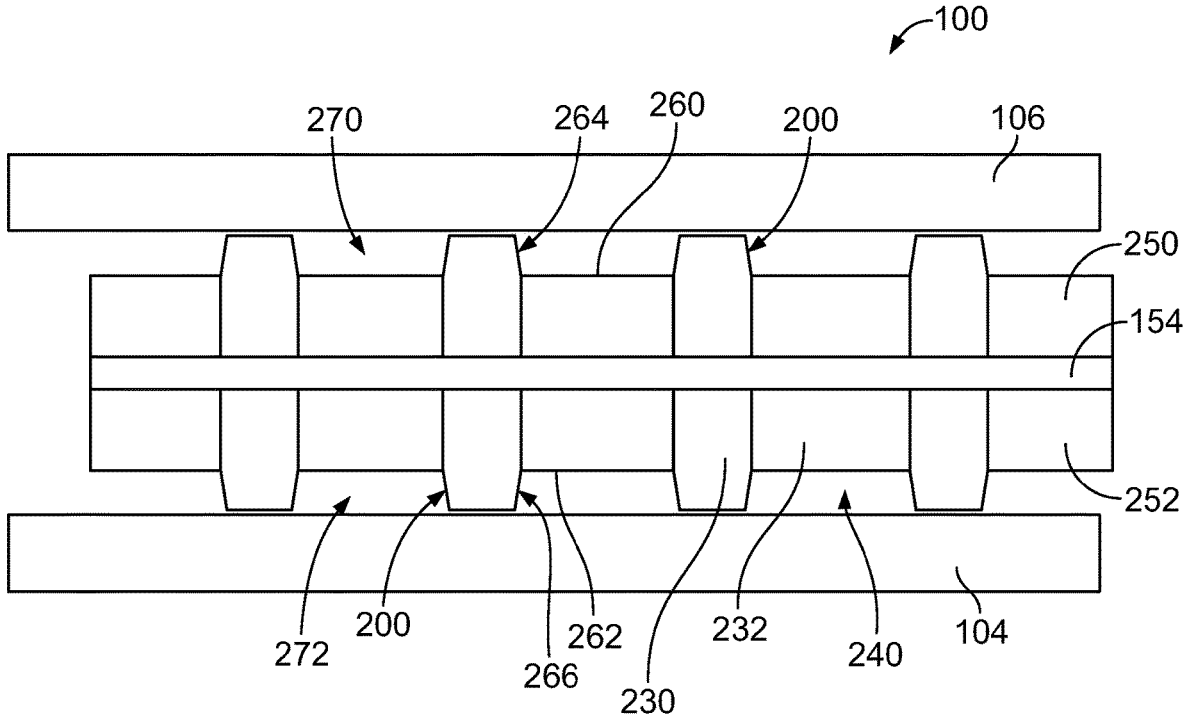
FIG. 10 is a side view of a portion of the electrical connector assembly in accordance with an exemplary embodiment showing the contacts coupled to the carrier.

FIG. 10 is a side view of a portion of the electrical connector assembly 100 in accordance with an exemplary embodiment showing the contacts 200 coupled to the carrier 154. In the illustrated embodiment, the inner cores 230 includes the upper tips 264 extending above the outer surface 260 of the upper sheet 250 the lower tips 266 extending below the outer surface 262 of the lower sheet 252. The tips 264, 266 engage the component circuit board 106 and the host circuit board 104. The outer support bodies 232 (for example, the upper sheet 250 and the lower sheet 252) substantially fill the gaps 240 between the inner cores 230. When the assembly is compressed, the inner cores 230 are compressed. The inner cores 230 flex outward when compressed. The outer support body 232 provides mechanical support for the inner cores 230. Relief spaces 270, 272 are provided above the upper sheet 250 and below the lower sheet 252. The relief spaces 270, 272 allow the sheets 250, 252 to flex outward when the inner cores 230 are compressed.

Figure 11:
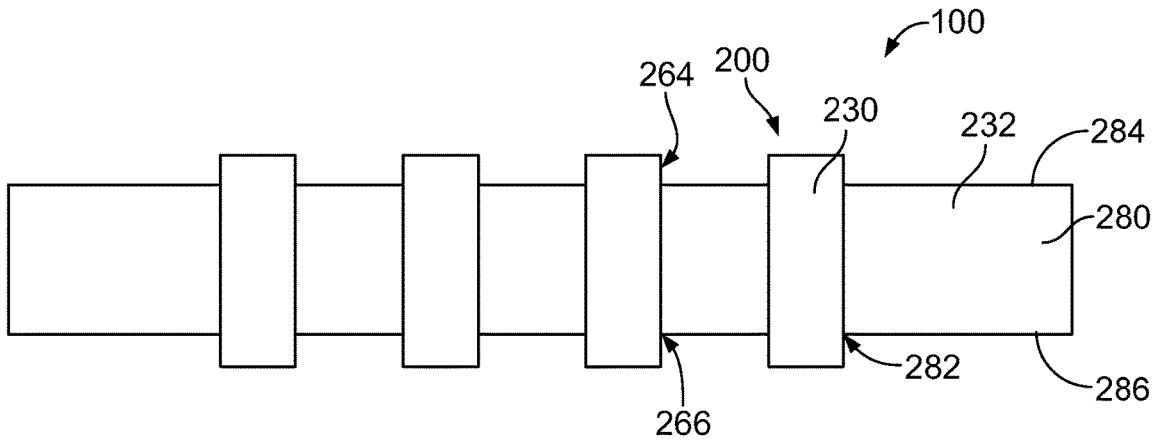
FIG. 11 is a side view of a portion of the electrical connector assembly in accordance with an exemplary embodiment showing the contacts.

FIG. 11 is a side view of a portion of the electrical connector assembly 100 in accordance with an exemplary embodiment showing the contacts 200. In the illustrated embodiment, the outer support bodies 232 are formed as a single unitary structure for the inner cores 230. For example, rather than providing a separate carrier, upper sheet and lower sheet, the outer support bodies 232 are a single non-conductive polymer sheet 280 that supports all of the inner cores 230. The non-conductive polymer sheet 280 defines a carrier for the inner cores 230. The non-conductive polymer sheet 280 includes openings 282 that receive the inner cores 230. The inner cores 230 may be molded into the openings 282. The tips 264, 266 extend beyond the upper and lower surfaces 284, 286 of the sheet 280.

Figure 12:
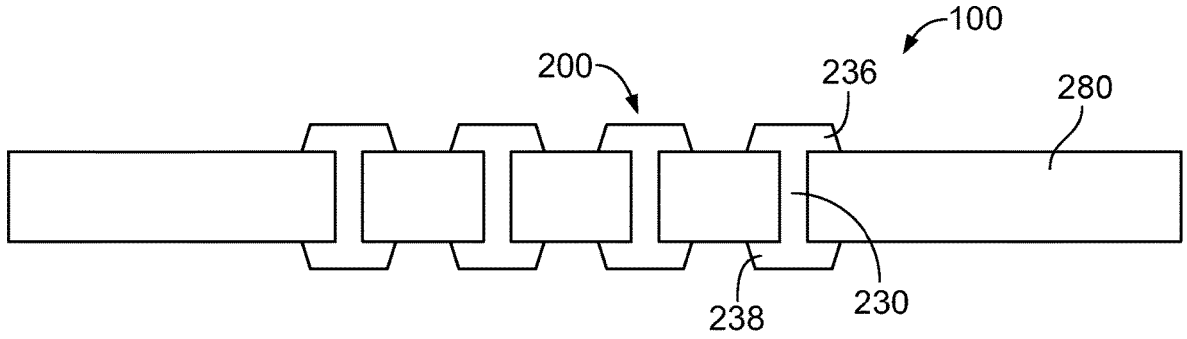
FIG. 12 is a side view of a portion of the electrical connector assembly in accordance with an exemplary embodiment showing the contacts.

FIG. 12 is a side view of a portion of the electrical connector assembly 100 in accordance with an exemplary embodiment showing the contacts 200. In the illustrated embodiment, the inner cores 230 of the contacts 200 includes the upper caps 236 and the lower caps 238 extending along the sheet 280.

The above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembly comprising:

a carrier having an upper surface and a lower surface, the lower surface configured to face a host circuit board, the upper surface configured to face a component circuit board of an electrical component, the carrier including a plurality of contact openings therethrough;

contacts coupled to the carrier and passing through the corresponding contact openings, each contact having a conductive polymer column extending between a upper mating interface and a lower mating interface, the conductive polymer column being compressible between the upper mating interface and the lower mating interface, the conductive polymer column including an inner core and an outer support body, the inner core being manufactured from a first material, the outer support body being manufactured from a second material, the second material having a lower compression set than the first material, the first material having a higher electrical conductivity than the second material.

2. The electrical connector assembly of claim 1, wherein the first material of the inner core is a conductive polymer and wherein the second material of the outer support body is a non-conductive polymer.

3. The electrical connector assembly of claim 1, wherein the inner core is formed in place on the carrier and wherein the outer support body is formed in place on the carrier.

4. The electrical connector assembly of claim 1, wherein the outer support body is secured to the carrier by a first molding and wherein the inner core is secured to the carrier and the outer support body by a second molding.

5. The electrical connector assembly of claim 1, wherein the inner core is secured to the carrier by a first molding and wherein the outer support body is secured to the carrier and the inner core by a second molding.

6. The electrical connector assembly of claim 1, wherein the inner core is cylindrical between the upper mating interface and the lower mating interface.

7. The electrical connector assembly of claim 1, wherein the inner core includes an upper cap at the upper mating interface and a lower cap at the lower mating interface, the upper cap extending over a top of the outer support body, the lower cap extending under a bottom of the outer support body.

8. The electrical connector assembly of claim 1, wherein each outer support body includes an upper portion between the upper surface of the carrier and the upper mating interface and includes a lower portion between the lower surface of the carrier and the lower mating interface, the upper portion being frustoconical shaped, the lower portion being frustoconical shaped.

9. The electrical connector assembly of claim 1, wherein the inner cores are spaced apart by gaps, the outer support body substantially filling the gaps.

10. The electrical connector assembly of claim 1, wherein the outer support bodies of adjacent contacts are integrally formed from a unitary sheet.

11. The electrical connector assembly of claim 1, wherein the outer support bodies are integrally formed with the carrier as a unitary support structure for the inner cores.

12. The electrical connector assembly of claim 1, further comprising an upper sheet having upper openings and a lower sheet having lower openings, the upper sheet coupled to the upper surface of the carrier with the upper openings aligned with the contact openings of the carrier, the lower sheet coupled to the lower surface of the carrier with the lower openings aligned with the contact openings of the carrier, the upper sheet forming upper portions of the outer support bodies of the contacts, the lower sheet forming lower portions of the outer support bodies of the contacts, the inner cores passing through the corresponding contact openings, the corresponding upper openings and the corresponding lower openings.

13. An electrical connector assembly comprising:

a carrier having an upper surface and a lower surface, the lower surface configured to face a host circuit board, the upper surface configured to face a component circuit board of an electrical component, the carrier including a plurality of contact openings therethrough;

contacts coupled to the carrier and passing through the corresponding contact openings, each contact having a conductive polymer column extending between an upper mating interface and a lower mating interface, the conductive polymer column being compressible between the upper mating interface and the lower mating interface, the conductive polymer column including an inner core and an outer support body, the inner core being manufactured from a conductive polymer material, the outer support body being manufactured from a non-conductive polymer material, the non-conductive polymer material of the outer support body having a lower compression set than the conductive polymer material of the inner core, the conductive polymer material of the inner core having a higher electrical conductivity than the non-conductive polymer material of the outer support body, the inner cores being spaced apart by gaps, the outer support bodies substantially filling the gaps.

14. The electrical connector assembly of claim 13, wherein the outer support bodies of adjacent contacts abut against each other.

15. The electrical connector assembly of claim 13, wherein the outer support bodies of adjacent contacts are integrally formed from a unitary sheet.

16. The electrical connector assembly of claim 13, further comprising an upper sheet having upper openings and a lower sheet having lower openings, the upper sheet coupled to the upper surface of the carrier with the upper openings aligned with the contact openings of the carrier, the lower sheet coupled to the lower surface of the carrier with the lower openings aligned with the contact openings of the carrier, the upper sheet forming upper portions of the outer support bodies of the contacts, the lower sheet forming lower portions of the outer support bodies of the contacts, the inner cores passing through the corresponding contact openings, the corresponding upper openings and the corresponding lower openings.

17. The electrical connector assembly of claim 13, wherein each inner core has an upper tip extending above the outer support body and a lower tip extending below the outer support body, the upper tip configured to engage the component circuit board such that an upper relief space is provided between the outer support body and the component circuit board, the lower tip configured to engage the host circuit board such that a lower relief space is provided between the outer support body and the host circuit board, the outer support body extending into the upper relief space and the lower relief space when the conductive polymer column is compressed.

18. An electrical connector assembly comprising:

a carrier having an upper surface and a lower surface, the lower surface configured to face a host circuit board, the upper surface configured to face a component circuit board of an electrical component, the carrier including a plurality of contact openings therethrough;

contacts coupled to the carrier and passing through the corresponding contact openings, each contact having a conductive polymer column extending between a upper mating interface and a lower mating interface, the conductive polymer column being compressible between the upper mating interface and the lower mating interface, the conductive polymer column including an inner core and an outer support body defined by the carrier, the outer support body extending between the upper surface and the lower surface, the inner core being manufactured from a first material, the carrier defining the outer support body being manufactured from a second material, the second material having a lower compression set than the first material, the first material having a higher electrical conductivity than the second material.

19. The electrical connector assembly of claim 18, wherein the first material of the inner core is a conductive polymer and wherein the second material of the carrier and the outer support body is a non-conductive polymer.

20. The electrical connector assembly of claim 18, wherein the carrier and the outer support bodies for each of the contacts are a unitary structure.

* * * * *